United States Patent [19]

Kuna et al.

[11] 4,340,223

[45] Jul. 20, 1982

[54] MICROCOMPUTER CONTROLLED REACTION GAME

[75] Inventors: Wayne A. Kuna, Oak Park; Christian H. Oberth, Chicago, both of Ill.

[73] Assignee: Marvin Glass & Associates, Chicago, Ill.

[21] Appl. No.: 229,921

[22] Filed: Jan. 30, 1981

[51] Int. Cl.[3] ..... A63B 71/04

[52] U.S. Cl. ..... 273/1 GC

[58] Field of Search ..... 273/1 GC, 287, 138 A, 273/856, 310–315

[56] References Cited

U.S. PATENT DOCUMENTS

| | | | |
|---|---|---|---|
| 3,770,269 | 11/1973 | Elder | 273/138 A |
| 3,927,880 | 12/1975 | Petrusek | 273/138 A |
| 4,034,990 | 7/1977 | Baer | 273/85 G |
| 4,060,242 | 11/1977 | Huang et al. | 273/138 A |
| 4,215,861 | 8/1980 | Nemeth | 273/85 G |

*Primary Examiner*—Vance Y. Hum
*Assistant Examiner*—Leo P. Picard
*Attorney, Agent, or Firm*—Mason, Kolehmainen, Rathburn & Wyss

[57] ABSTRACT

A microcomputer controlled game apparatus utilizes a microcomputer for controlling the play of one or more games a participant may play against the machine or against another participant. The device includes a housing having a playing surface with a plurality of light emitting elements arranged across the surface including one or more elements associated with each player. The light emitting elements are conveniently covered by a translucent screen bearing insect or other indicia which is illuminated when the underlying light emitting element is actuated. The light emitting elements are sequentially actuated in an apparently random path by the microcomputer located within the housing. When a player's light emitting element is illuminated, the player has a predetermined time to actuate a manually actuable switch. The microcomputer records the player's success in actuating the switch within the predetermined time of illumination of the selected light emitting element and then controls the rate of sequential actuation of the light emitting element in response to the player's success or lack of success.

13 Claims, 7 Drawing Figures

Fig 3
GAME 1
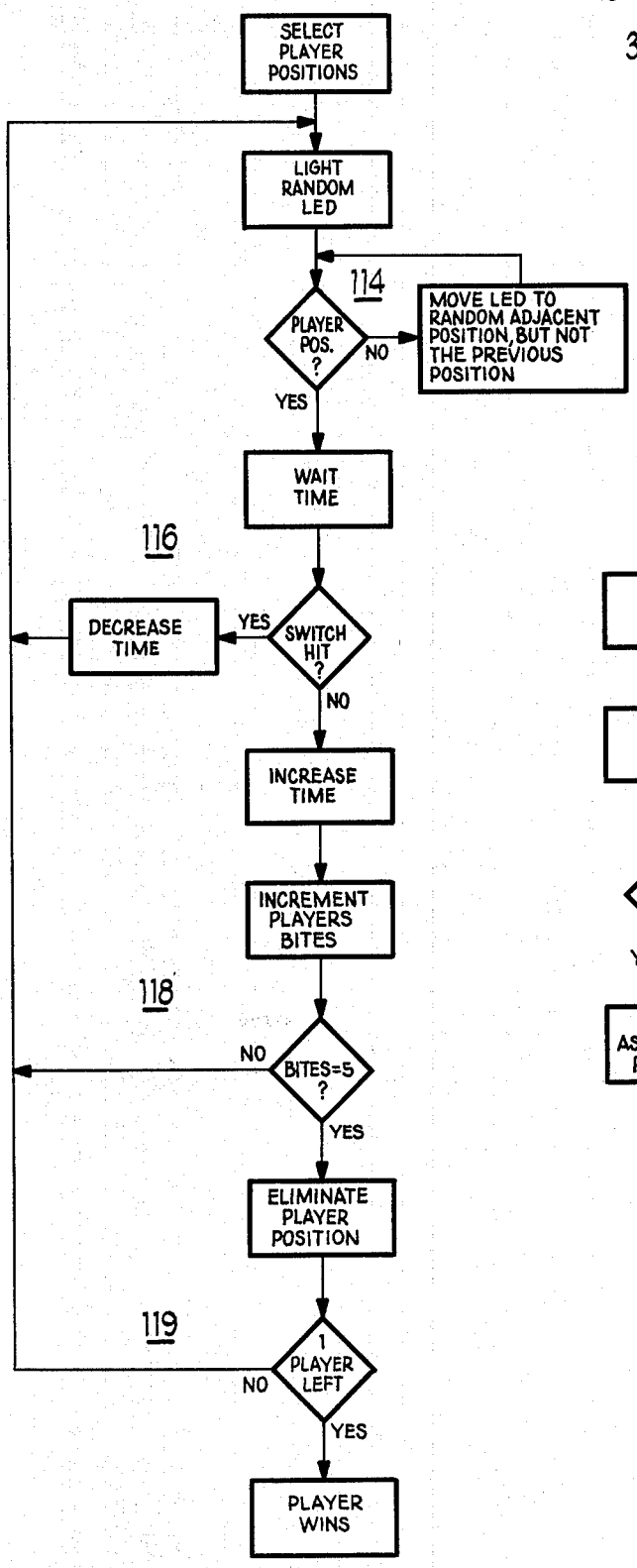
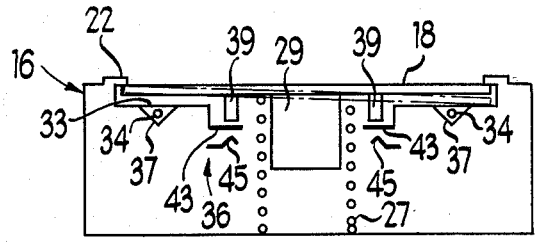
Fig 7
Fig 4
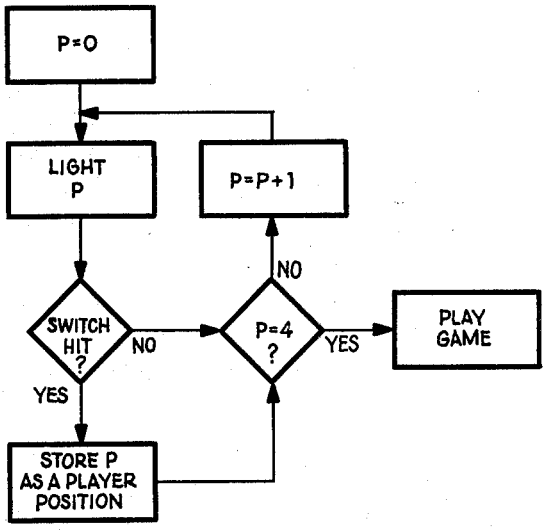

GAME 2

GAME 3

MICROCOMPUTER CONTROLLED REACTION GAME

BACKGROUND OF THE INVENTION

1. Field of the Invention

This invention relates generally to game devices and more particularly to an electrical board game device which utilizes audible and visual indications in connection with the play of one or more games and to advise the participant of the progress of the game being played.

2. Description of the Prior Art

Microcomputers have become widely available and various electronic board games have been devised utilizing these microcomputers. One such game is disclosed in U.S. Pat. No. 4,207,087, assigned to the assignee of record of the present application. In addition, other games have been devised such as the games referred to in that patent as well as many commercially available games.

SUMMARY OF THE INVENTION

Many objects and advantages including considerable entertainment value are achieved by a microcomputer controlled game device including a housing having a playing surface. A plurality of light emitting elements are spaced across the surface and means for sequentially illuminating the elements are contained within the housing. A manually actuable switch is positioned on the housing. Means are provided for controlling the operation of the illuminating means which includes means for monitoring the switch and means for determining whether the switch is actuated within a predetermined time period after the selected light emitting element is illuminated.

BRIEF DESCRIPTION OF THE DRAWING

FIGS. 3 through 6 are logical flow charts illustrating the functions performed by the microcomputer controlling the operation of the embodiment of the present invention shown in FIG. 1; and FIG. 7 is a reduced, partial, cross-sectional view taken generally along the line 7—7 in FIG. 1.

DETAILED DESCRIPTION OF THE PREFERRED EMBODIMENT

Figure 1:
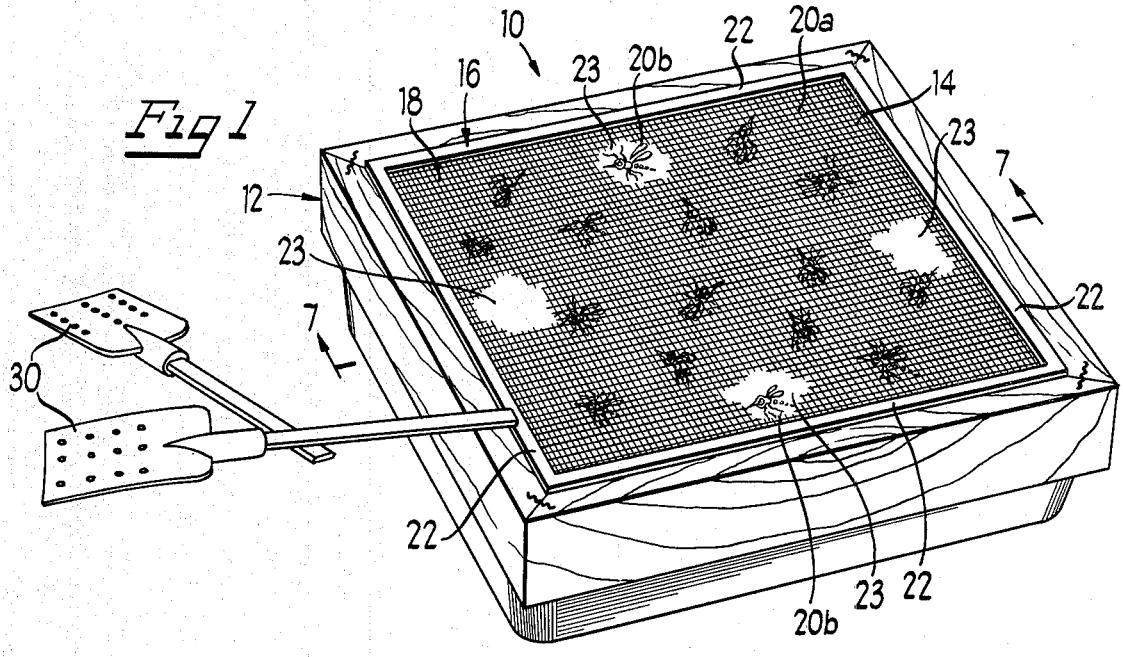
FIG. 1 is a perspective view of one embodiment of the present invention.

Referring to the drawing wherein like reference characters are used for like parts throughout, there is illustrated in FIG. 1, a microcomputer controlled game device 10 including a housing 12, conveniently formed of hollow molded plastic. The housing 12 includes a rectangular frame 16, conveniently simulating a wooden box, and a central screen 18 supported on the rectangular frame 16 and forming a playing surface 14 on housing 12.

The central screen 18 is preferably formed of a sheet of translucent material such as plastic or the like, bearing indicia 20 including a plurality of intersecting line indicia 20*a* giving the appearance of a metal wire screen and a plurality of insect indicia 20*b*, such as mosquito indicia, spaced equally across playing surface 14 conveniently positioned on the underside of the screen 18. In addition, at four locations near each side 22 of frame 16 a jagged open area 23 is formed where no line indicia 20*a* is provided.

The screen 18 is tiltably mounted, with respect to the frame 16, on a coiled spring 27 as shown in FIG. 7. The spring 27 encircles and is attached at its upper end to a central downwardly directed post 29 on the lower side of the screen 18 and extends downwardly from the bottom of the post 29 for attachment to the bottom 31 of the housing 12. Thus the screen 18 can be tilted around the spring 27, as indicated in dotted lines when the screen 18 is depressed along one of its sides 22. Upon release, the screen 18 springs back to its level orientation. A pair of fly swatters 30 are useful for swatting the screen 18 to cause it to tilt on the spring 27.

Located directly beneath the screen 18 within the housing 12 a light emitting element supporting surface 33 is connected to the frame 16. A plurality of light emitting elements 34 conveniently light emitting diodes, which when actuated illuminate, through the translucent central screen 18, the overlying bug indicia 20*b*. If necessary the light emitting elements may include appropriate shields 37 to prevent the erroneous appearance that the adjacent bug indicia 20*b* are illuminated.

A plurality of switch actuators 39 arranged symmetrically around the post 29 and spaced about 90 degrees from one another, extend downwardly from the screen 18 past the surface 33, into alignment with a reciprocating switch 36. The switch 36 conveniently includes four cantilevered contacts 43 mounted on the lower side of the surface 33, each in alignment with one of the actuators 39. Each control 43, spaced above another contact 45, is connected to a source of electrical potential and each of the contacts 45 is eventually connected to a ground. Each contact 45 and its associated control 43 form a switch in parallel with the switches formed by the other contacts 43 and 45 so that the switch 36 is closed when any contact 43 makes electrical connection with a contact 45.

Figure 2:
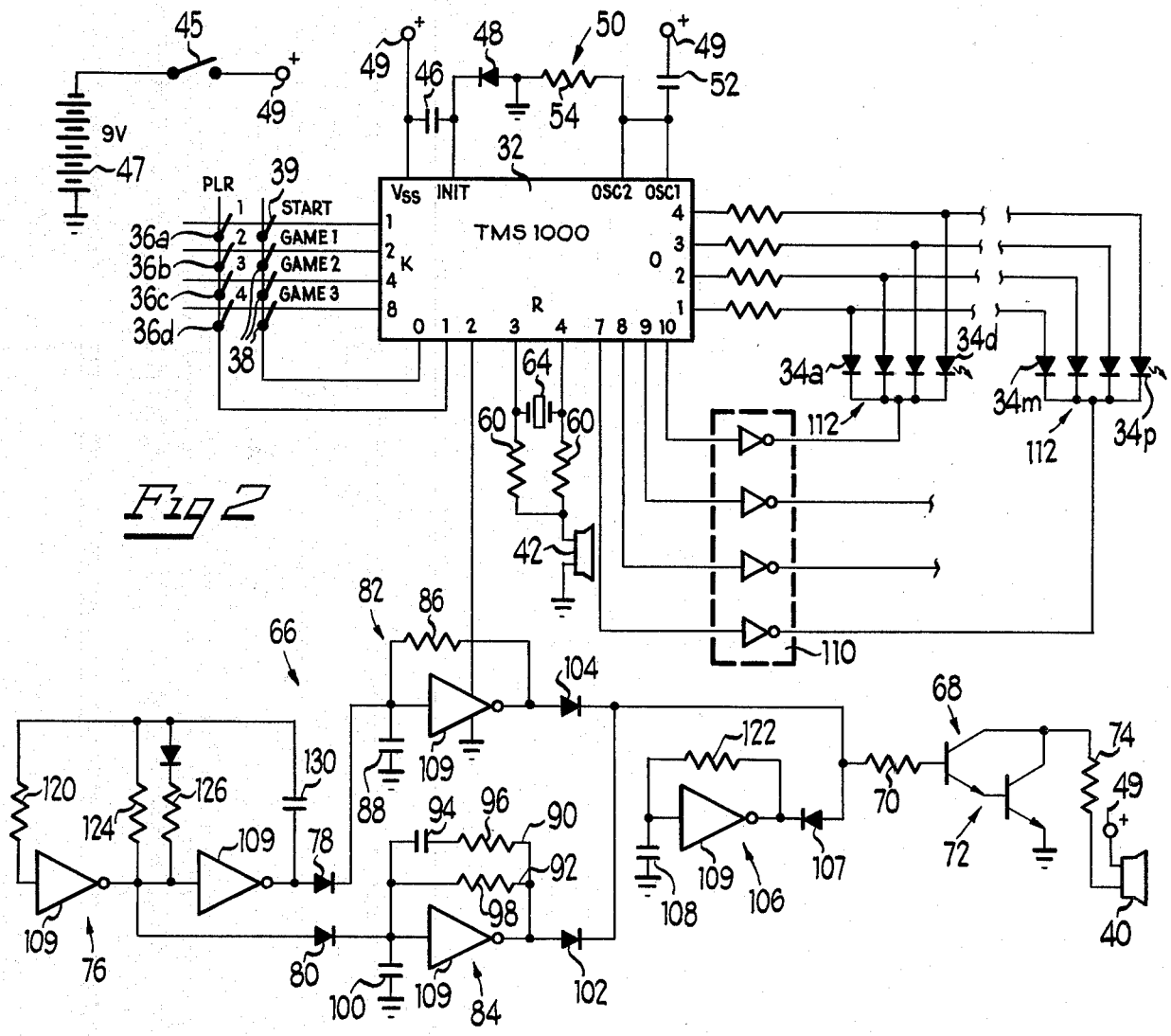
FIG. 2 is a detailed circuit schematic of the electronic circuitry of the embodiment shown in FIG. 1.

Referring now to FIG. 2, a microcomputer 32, contained within the housing 12, is electrically connected to the light emitting elements 34, conveniently light emitting diodes, located beneath each bug indicia 20*b* on the playing surface 14. In addition the microcomputer 32 is electrically connected to the switch 36, located within housing 12 to be actuated in response to the tilting of the screen 18, the game select switches 38 and the start switch 39 (not shown in FIG. 1). The switches 38 are manually operable to select one or more games which may be played with the device 10 and the switch 39 is manually operative to start the selected game. The microcomputer 32 also controls a pair of speakers 40 and 42 that produce sounds useful in implementing various games.

As indicated above, several games may be played using the device 10. These games are conveniently selected by actuating an appropriate game select switch 38. While only three such games are described below, the microcomputer 32 shown diagrammatically in FIG. 2 and described below may be programmed to play a variety of other games.

GAME 1

This game may be played between two or more players. When the game select switch 38 appropriate to select Game 1 and the switch 39 are actuated, the light emitting elements 34 are rapidly illuminated to produce a quick flash of light one after another proceeding from one element 34 to an adjacent element 34 in a path controlled by the microcomputer 32. Each time a light emitting element 34 is illuminated its overlying bug indicia 20*b* is illuminated, appearing to have come to life. Each player is assigned one area 23 which that player must monitor. If the light emitting element 34 located beneath the area 23 assigned to that player is illuminated, the player must within a predetermined time actuate the switch 36 using a fly swatter 30. If the player is successful in actuating the screen 18 within the predetermined time, the speed of the illumination of light emitting elements 34 is increased. However, if the player is not successful in actuating the screen 18 within the predetermined time, the rate of illumination of the light emitting element 34 is decreased and the player receives one point. The number of successful switch actuations at each open area 23 is continuously recorded by the microcomputer 32. When a player has received five points, the player is eliminated from play. The winner is the last remaining player.

GAME 2

Game 2 is also played between two or more players. It differs from Game 1 in that each time the player successfully actuates the screen 18 within the predetermined time period after illumination of a light emitting element 34 located beneath the player's area 23, that player receives one point. The first player to receive five points is the winner.

GAME 3

Game 3 may be played either between a participant and the machine or between a number of different participants. One light emitting element 34 is flashed on and then off and subsequently adjacent elements are illuminated one after another in a zig-zag path until the light emitting element 34 associated with an open area 23 is illuminated. The player then has a predetermined amount of time to actuate the screen 18. Preferably this time period corresponds to the duration of the flash illumination of the elements 34. If the player is successful that light emitting element 34 is turned off. At set time intervals an additional light emitting element is illuminated and thereafter subsequent light emitting elements are illuminated giving the appearance that the light just illuminated is moving in an erratic path. Conveniently, ten such light paths are sequentially begun and each time the player is successful in turning off a light emitting element 34 one such path is eliminated. If the player extinguishes all ten light emitting paths in a predetermined time, he or she has beaten the machine. If not the player can determine his or her success by counting the number of light emitting elements still illuminated on the board and this number can be compared to the performance of other players to set up a competition between various participants.

The above-described games have been given by way of example only, the number of possible games limited only by the capability of the microcomputer 32 and the ingenuity of its programmer. The number of games that may be played is considerably greater than the three examples given above.

Referring now in greater detail to FIG. 2, the microcomputer 32 can be implemented using a single chip large scale integrated microcomputer. The TMS 1100 single chip microcomputer manufactured by Texas Instruments, Inc. is suitable for use as the microcomputer 32 and the chip contains the input and output circuitry, the arithmetic logic unit, and the memory required to implement the device 10. A plurality of batteries 47 conveniently supply a potential, when the on/off switch 45 is closed, to each of the terminals 49.

A time delay circuit comprising a capacitor 46 and a diode 48 serves to reset and initiate the operation of the microcomputer 32 each time the power is turned on and off by the on/off switch 45. A timing circuit generally designated 50 controls the operation of the internal clock of the microcomputer 32. The timing circuit 50 includes a capacitor 52 and a resistor 54.

The microcomputer 32 has a plurality of outputs designated as R0 through R10 and a plurality of inputs designated as K1, K2, K4 and K8. The output R0 can be coupled to one of the inputs K1, K2, K4 or K8 through any game select switch 38 or the start switch 39 so that the microcomputer can determine when any of these switches have been selected. Similarly, the output R1 can be coupled to any input K1, K2, K4 or K8 through the switch 36.

For example in one preferred embodiment instead of using a single common switch 36, the contacts 43 and 45 are independently wired to form four independent switches 36*a*–36*d*. Then the microcomputer 32 can compare the actuated switch 36*a–d* with the location of the illuminated area 23 at the time of actuation.

In another preferred embodiment using a common switch 36 the microcomputer 32 determines whether the switch 36 is actuated within a certain time of illumination of an open area 23. If so, the microcomputer 32 records one hit and, if not, it records one miss.

The output R2 controls the loudspeaker 40 and the outputs R3 and R4 control the loudspeaker 42. The loudspeaker 42 produces various distinct razzing sounds and melodies useful in implementing the play of the above-described games. The output of the loudspeaker 42 is controlled by resistors 60 and crystal 64.

The loudspeaker 40 conveniently generates a buzzing or humming sound similar to that produced by mosquitoes and other insects. When output R2 is high an oscillator circuit 66 supplies a rapidly varying waveform to loudspeaker 40 through amplifier circuit 68. The amplifier circuit 68 includes a resistor 70, a Darlington pair 72 and a resistor 74.

The oscillator 66 includes a free running astable multivibrator 76 which supplies outputs of different frequency and phase to the diodes 78 and 80. A low frequency signal produced by the multivibrator 76, passing through the diode 78, is received by a frequency modulator 82 while another low frequency signal produced by the multivibrator 76 passing through the diode 80, is received by a frequency modulator 84. The frequency modulator 82 is conveniently a free running astable multivibrator with a resistor 86 and capacitor 88 which produce a higher frequency output than the output received through the diode 78. Similarly the frequency modulator 84 is a free running astable multivibrator with a pair of feedback loops 90 and 92. The loop 90 includes a capacitor 94 and a resistor 96 while the loop 92 includes only a resistor 98. Each loop 90 and 92 adds a different frequency component in conjunction with capacitor 100 to the signal received through diode 80.

The outputs from the frequency modulators 82 and 84 are combined after passing through diodes 102 and 104. Before reaching the amplifier 68 the combined signal waveform is alternately grounded by the free running astable multivibrator 106 through the diode 107 to produce a wavering output waveform.

The resulting randomly varying high frequency signal is supplied through amplifier 68 to speaker 40 to produce a rapidly varying output similar to wavering white noise. The entire oscillator circuit 66 can be implemented using a single integrated circuit such as the circuit denominated 4584 including six separate inverting Schmidt triggers 109.

By way of illustration only, the following circuit values have been found to be satisfactory for the oscillator 66:

| CAPACITORS | MICROFARADS | RESISTORS | KILOHMS |
|---|---|---|---|
| 88 | .1 | 86 | 22 |
| 94 | 1.5 | 96 | 180 |
| 100 | .1 | 98 | 1 |
| 108 | .1 | 120 | 15 |
| 130 | 2.2 | 122 | 15 |
| | | 124 | .33 |
| | | 126 | 220 |

The outputs R7 through R10 are connected through a buffer 110 to the cathodes of four sets of four light emitting elements 34. When one of the outputs R8 through R10 goes high, the high state is applied through the buffer 110 thereby causing the cathode of one set of four diodes 112 to be returned on. The 01 through 07 outputs of the microcomputer 32 are then utilized to select which of the four diodes 34 of the selected set 112 is to be operated. Thus, for example, the output 01 controls the display element **34*a* during the time that the R10 output is high, and the element 34M** during the time that the output R7 is high.

With this arrangement of inputs and outputs, the microcomputer 32 is able to continuously monitor the state of switches 36, 38 and 39, by sequentially energizing its outputs R0 and R1 in accordance with programmed instructions. In addition, by applying distinct signals to outputs R2 through R10 and 01 through 04, distinct visual and audible indications can be produced to control the play of the various games.

More specifically, when the R1 output is energized the microcomputer 32 can determine which switch **36*a–d* has been actuated by monitoring the inputs K1, K2, K4 and K8 or if a common switch 36 is utilized the actuation of that switch is quickly sensed. If none of the inputs are energized, none of the switches has been operated. Similarly the microcomputer 32 can determine which of the games has been selected using the switches 38 or 39 by monitoring its inputs when its output R0 is high. In this way the microcomputer 32 is able to determine when any switch 36, 38 or 39 has been actuated by sequentially monitoring those switches and more importantly the microcomputer 32 is able to determine which of those switches 36, 38 or 39** has been actuated.

By applying appropriate signals to outputs R2 through R10 and 01 and 04 distinct visual and audible indications, effective to control the play of the game are produced. Specifically, the elements 34 are sequentially illuminated in an apparently erratic path. A variety of such illumination sequences are retained in the memory of the microcomputer 32, so that different sequences are used sequentially for each player and each game. Alternatively, the illumination path of the elements 34 may be chosen by a random selection program.

The microcomputer 36 is readily programmed in the manner described in the TMS 1000 series data manual published in December, 1975 by Texas Instruments, Inc. to perform the functions necessary to play the desired games. Flow charts illustrating the programming of the microcomputer 32 for the games particularly described herein are illustrated in FIGS. 3 through 6.

Referring to FIG. 3, when Game 1 or 2 has been selected through the appropriate switch 38 a player position selection subprogram shown in FIG. 4 is immediately called up. Through this program the microcomputer 32 determines how many players are playing and where they are located by sequentially illuminating a light emitting element 34 contained in housing 12 beneath each open area 23. If a player intends to adopt that open area 23 as the one which he or she will defend the player depresses the screen 18 downwardly at the selected open area 23 when the light emitting element 34 is operated. Each occupied player position is then stored in the microcomputer's random access memory.

Returning now to FIG. 3, Game 1, upon selection of the appropriate switch 38, begins upon actuation of the start switch 39 by illuminating one light emitting element 34. In loop 114 a check is made to determine if the illuminated light emitting element is one associated with one of the open areas 23 and if this is not the case, another adjacent light emitting element is illuminated. As one light emitting element 34 after another is flashed on and then off it appears that the insect indicia **20*b* is moving erratically along the playing surface 14. When one of the elements 34 associated with an opening 23 is finally illuminated the microcomputer determines, through the loop 116, if the screen 18 has been actuated within a predetermined time period. If this is the case, the light emitting element 34** is deactuated and the time period to actuate the screen thereafter is decreased.

On the other hand if the player is unsuccessful in actuating the screen 18 within the available time period, the time for the players to actuate the screen 18 thereafter is increased and the player receives one "bite" in the loop 118. The program then iterates back to the beginning and a new light emitting element 34 is illuminated and thereafter "moved" across the surface 14 as described previously, preferably following a different path. When one player receives five "bites" that player is eliminated in the loop 119 and the play proceeds until only one player, the winner, remains. During the play of the game a humming sound is automatically produced through loudspeaker 40. In addition a distinct sound is produced through loudspeaker 42 depending on whether the player's actuation of pushbutton 28 is successful or not and a distinct sound is produced on loudspeaker 42 each time a player is eliminated.

Figure 5:
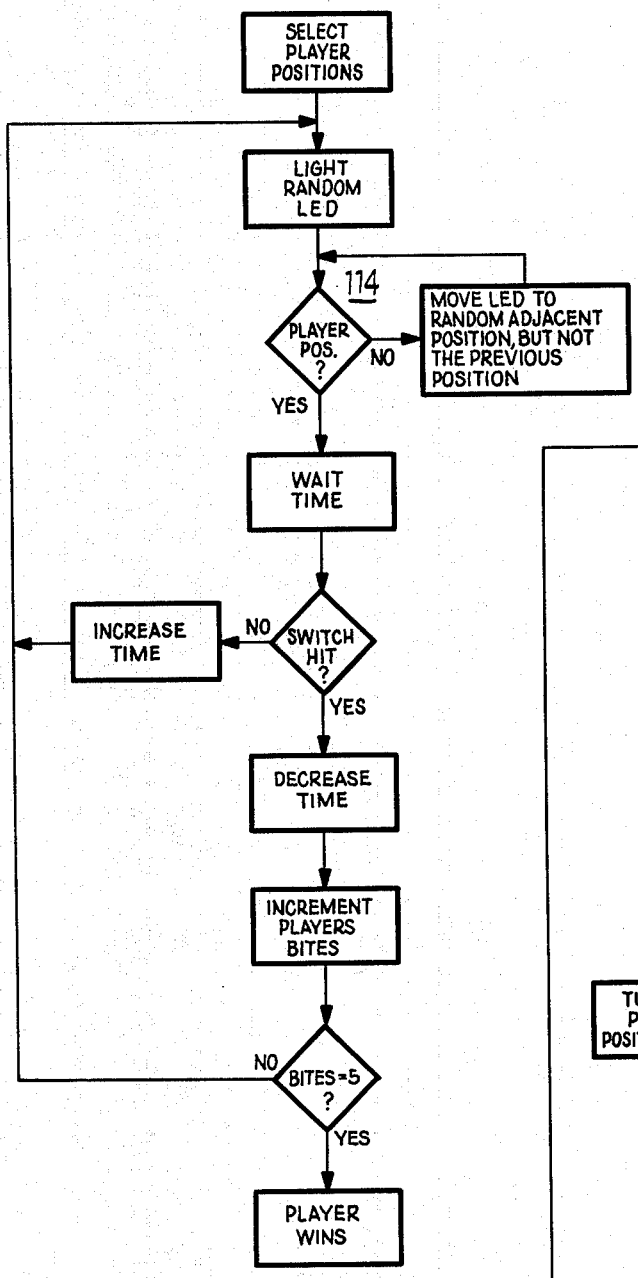

Referring now to FIG. 5, if Game 2 has been selected by the actuation of the appropriate switch 38 the device 10 again stores the player positions as described previously. As shown in FIG. 5, the illumination of the light emitting elements 34 and their progress across the game surface 14 is similar to that in Game 1. However, in Game 2, instead of eliminating unsuccessful players, the first player to successfully operate the screen 18 in the required time period five times is the winner. Again appropriate sounds are created through loudspeakers 40 and 42 in accordance with the play of the game.

Figure 6:
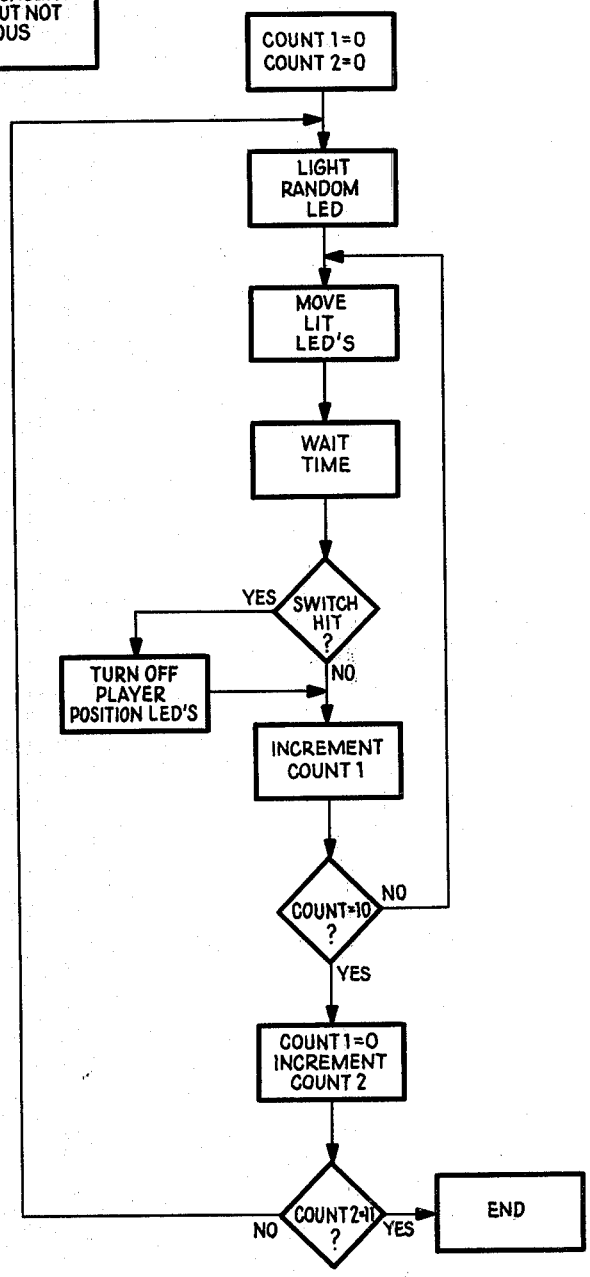

Finally, if Game 3 has been selected, the program proceeds according to FIG. 6. A first and second count are initialized and a first random light emitting element 34 is illuminated and thereafter "moved" across the game surface as described previously. If a player successfully actuates the screen 18 within a set time period after the light emitting element 34 associated with the player's opening 23 is illuminated, that light emitting element 34 is terminated. In either case the first count is incremented and a check is made to determine if the first count equals ten. If this is not the case, the light emitting element 34 originally illuminated is sequentially "moved" across the game surface 14 until the count equals ten or a player successfully actuates the screen 18 causing the element to be turned off. Thereafter the first count is initialized and the second count is incremented. A check is made to see if the second count equals eleven and if this is not the case, a new light emitting element is actuated. Thus if the player still has not successfully extinguished the first illuminated light emitting element the player will now see two elements 34 illuminated at the same time progressing to different adjacent elements thereby creating two moving light paths on the surface 14. Additional light emitting elements 34 are activated at predetermined intervals until ten light emitting elements have been illuminated. When the predetermined time delay is up, all the light emitting elements are frozen and the player determines his or her success at the game by counting the number of remaining light emitting elements.

It should be understood that numerous modifications of the invention described herein can be designed by others skilled in the art, that fall within the scope and spirit of the principles of this invention, even if the invention is not practiced as specifically described herein.

What is claimed and desired to be secured by Letters Patent of the United States is:

1. A microcomputer controlled game device comprising:

a housing having a playing surface means for moving said playing surface;

a plurality of light emitting elements spaced across said surface;

means for sequentially illuminating said elements in an erratic path;

a manually actuable switch on said housing means for providing coaction between said switch and said playing surface and means for establishing a predetermined time period;

and means for controlling the sequence of operation of said illuminating means, said controlling means including means for monitoring said switch and means for determining whether said switch is actuated coincident with an illuminated light emitting element within a predetermined time period after said selected light emitting element is illuminated.

2. The game device of claim 1 including means for producing a humming sound.

3. The game device of claim 1 including a microcomputer, said microcomputer including means for continuously monitoring the state of said switch.

4. The game device of claim 1 wherein said playing surface includes a translucent sheet, said light emitting elements positioned beneath said sheet, said sheet bearing insect indicia on a surface thereof.

5. The game device of claim 1 including means for sequentially flashing said light emitting elements in an erratic path from one adjacent element to another.

6. The game device of claim 5 including means for storing a plurality of actuation sequences for said light emitting elements and means for selecting a different sequence upon each successive operation of said device.

7. The game device of claim 1 including means for accumulating the number of times a player has successfully actuated said switch within said predetermined time period.

8. The game device of claim 1 including means for changing the predetermined time period in response to a player's success or lack of success in the game.

9. The game device of claim 1 including at least three selected light emitting elements and said means for deactivating one of said selected light emitting elements after a predetermined number of unsuccessful actuations of said switch.

10. The game device of claim 1 including means for increasing the number of light emitting elements which are illuminated after a predetermined time delay, said means including means for sequentially moving the pattern of illumination of said light emitting elements through at least two distinct paths.

11. The game device of claim 10 including means for decreasing the number of said paths when a player successfully actuates said switch within said predetermined time period.

12. The game device of claim 1 including a plurality of switches associated with a plurality of said light emitting elements and another set of a plurality of light emitting elements not associated with any of said switches.

13. The game device of claim 1 said playing surface being tiltably mounted in said housing, said switch operable when said surface is tilted in any direction.

* * * * *